US006554644B2

(12) United States Patent
Koide

(10) Patent No.: US 6,554,644 B2
(45) Date of Patent: Apr. 29, 2003

(54) SHIELDING TERMINAL

(75) Inventor: Takashi Koide, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/909,377

(22) Filed: Jul. 20, 2001

(65) Prior Publication Data

US 2002/0019167 A1 Feb. 14, 2002

(30) Foreign Application Priority Data

Jul. 21, 2000 (JP) ..... 2000-220243

(51) Int. Cl.[7] ..... H01R 9/05

(52) U.S. Cl. ..... 439/585; 439/108; 439/578; 439/610

(58) Field of Search ..... 439/585, 578, 439/610, 607, 608, 877, 879, 108

(56) References Cited

U.S. PATENT DOCUMENTS

| | | | | |
|---|---|---|---|---|
| 5,567,179 A | | 10/1996 | Voltz | |
| 6,179,660 B1 | * | 1/2001 | Salaguinto et al. | 439/595 |
| 6,200,162 B1 | | 3/2001 | Aoyama et al. | |
| 6,210,223 B1 | | 4/2001 | Aoyama et al. | |

FOREIGN PATENT DOCUMENTS

| | | | |
|---|---|---|---|
| EP | 1 003 250 A1 * | 5/2000 | H01R/13/658 |
| GB | 1100786 | 1/1968 | |
| JP | 5-27983 | 4/1993 | |

* cited by examiner

*Primary Examiner*—Tho D. Ta
*Assistant Examiner*—James R. Harvey
(74) *Attorney, Agent, or Firm*—Anthony J. Casella; Gerald E. Hespos

(57) ABSTRACT

An inner metal lock 30 is formed in an upper surface of a connecting portion 15 of an inner terminal 11 by cutting the upper surface and bending a cut portion outward to project obliquely backward. A locking hole 32 is formed in the upper wall of a dielectric element 13. Inner surfaces of an accommodating hole 25 of the dielectric element 13 are formed with ribs 34 to 37 for partly filling a clearance between the inner surfaces and the connecting portion 15 of the inner terminal 11. When the inner terminal 11 is pushed to a proper position in the accommodating hole 25 of the dielectric element 13 fixed in the outer terminal 12, the inner metal lock 30 restores to its original shape and fits into the second locking hole 32. As a result, the inner terminal 11 is locked in the dielectric element 13. Simultaneously, the inner terminal 11 is accommodated so as not to shake with the left and right side surfaces of the connecting portion 15 pressed by first and second ribs on the left and right sides and with the upper and bottom surfaces thereof pressed by third and fourth ribs 36, 37.

8 Claims, 4 Drawing Sheets

SHIELDING TERMINAL

BACKGROUND OF THE INVENTION

1. Field of the Invention

The present invention relates to a shielding terminal to be connected with an end of a shielded cable. The invention also relates to a method for mounting a shielding terminal to a shielded cable.

2. Field of the Invention

A known shielding terminal is shown in FIGS. 8 and 9 and is provided with an inner terminal "a" to be connected with a mating terminal, an outer terminal "c" accommodating the inner terminal "a" and a dielectric element "b" provided therebetween. The inner terminal "a" is crimped into connection with an end of a core "e" of a shielded cable "d", and the outer terminal "c" is crimped into connection with ends of a braided wire "f" and a sheath "g" of the shielded cable "d". Such a shielding terminal is disclosed in Japanese Unexamined Utility Model Publication No. 5-27983 and other publications.

The shielding terminal of FIGS. 8 and 9 should have a sufficiently large fastening force to ensure that a pulling force on the shielded cable "d" does not detach the shielded cable "d" from the terminal. Conventionally, biting blades project from the outer surface of the inner terminal "a". The biting blades bite into the inner surface of the dielectric element "b" to prevent detachment.

However, the conventional shielding terminal has a groove formed in the inner surface of the dielectric element behind the biting blades. The groove prevents the dielectric element from exerting a sufficient force to prevent the detachment. Thus, there is a demand for a further improvement.

The present invention was developed in view of the above, and an object of the invention is to provide a shielding terminal and a mounting method that allows a larger fastening force of the shielding terminal to a shielded cable.

SUMMARY OF THE INVENTION

The invention is directed to a shielding terminal for connection with an end of a shielded cable. The cable has a core and a shield layer surrounding and spaced from the core. The shielding terminal comprises an inner terminal to be connected with the core of the shielded cable and an outer terminal to be connected with the shield layer of the shielded cable. The outer terminal accommodates the inner terminal with a dielectric element provided between the inner and outer terminals. At least one metal lock is formed in an outer surface of the inner terminal, and at least one locking hole is formed in an inner surface of the dielectric element for engagement by the metal lock.

Detachment of the connected inner terminal and core from the dielectric element is prevented effectively by fitting and engaging the metal lock into the locking hole. As a result, a fastening force of the shielding terminal to the shielded cable can be strengthened.

The metal lock preferably is formed by making at least one cut in the outer surface of the inner terminal and bending the cut portion.

The metal lock preferably projects obliquely backwards when seen in a direction of insertion of the inner terminal into the dielectric element.

The inner surface of the dielectric element preferably is formed with at least one filling portion that contacts the outer surface of the inner terminal for partly filling a clearance between the inner surface of the dielectric element and the inner terminal. The mere fitting of the metal lock into the locking hole makes the inner terminal likely to shake in the dielectric element. However, in the present invention, the filling portion fills the clearance, and hence the inner terminal is prevented from shaking. This, in turn, prevents fine sliding movements and abrasion between the inner terminal and a mating terminal.

The inner terminal may be formed with at least one resilient or elastic contact piece for contacting a mating terminal. The filling portion fills the clearance in a direction substantially parallel to an elastic deforming direction of the contact piece. The filling portion preferably is on an inner surface of the dielectric element facing the contact piece.

The inner terminal may be a female terminal with an elastic contact piece that undergoes an excessive elastic deformation due to forces exerted by a tab of a mating male terminal shaken in a direction parallel to the elastic deforming direction. However, in the present invention, the clearance is filled in the direction parallel to the elastic deforming direction of the contact piece. Thus, the inner terminal is prevented from shaking in the same direction, and the elastic contact piece will not undergo an excessive elastic deformation.

The at least one filling portion preferably comprises at least one projection that projects from the inner surface of the dielectric element.

The outer terminal preferably has an outer metal locking portion engageable with an auxiliary locking hole on an outer surface of the dielectric element for locking the dielectric element in the outer terminal.

The invention also is directed to a method for mounting, connecting or assembling a shielding terminal with an end of a shielded cable. The method comprises connecting an inner terminal with a core of the shielded cable, and connecting an outer terminal with a shield layer of the shielded cable while accommodating the inner terminal with a dielectric element provided between the inner and outer terminals. The inner terminal is locked with the dielectric element by engaging at least one metal locking portion formed in an outer surface of the inner terminal with at least one locking hole formed in an inner surface of the dielectric element.

The metal locking portion may be formed by making at least one cut in the outer surface of the inner terminal and bending the cut portion.

The method may further comprise the step of at least partly filling a clearance between the inner surface of the dielectric element and the inner terminal with at least one filling portion on the inner surface of the dielectric element for contacting the outer surface of the inner terminal.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
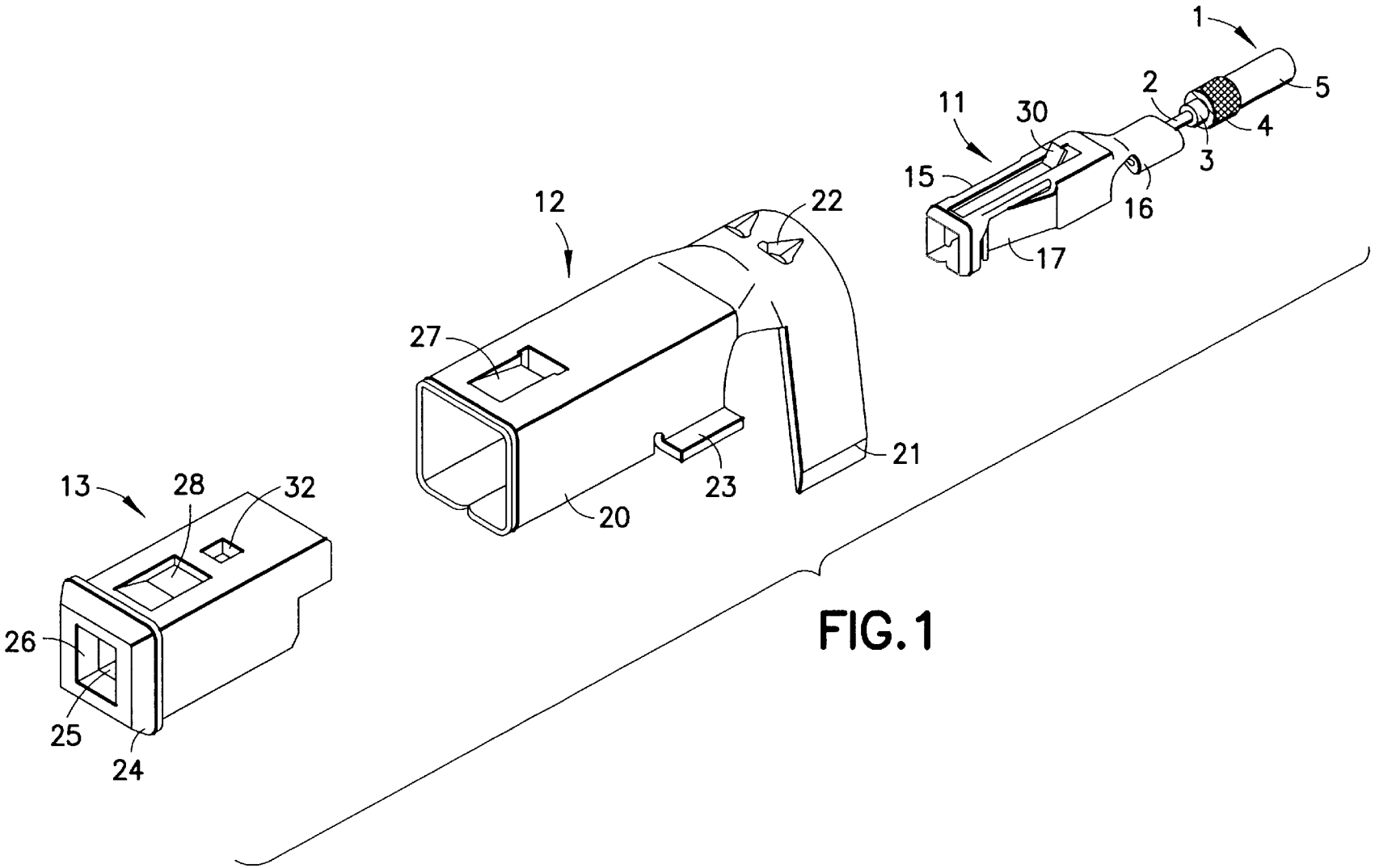
FIG. 1 is an exploded perspective view of one embodiment of the present invention.
Figure 2:
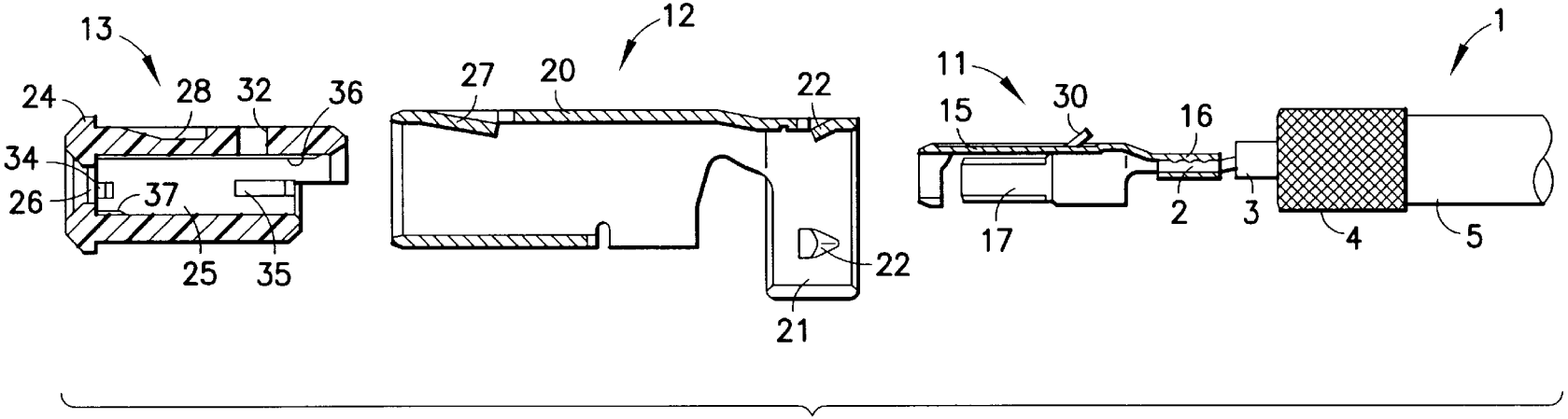
FIG. 2 is an exploded side view partly in section of this embodiment.
Figure 6:
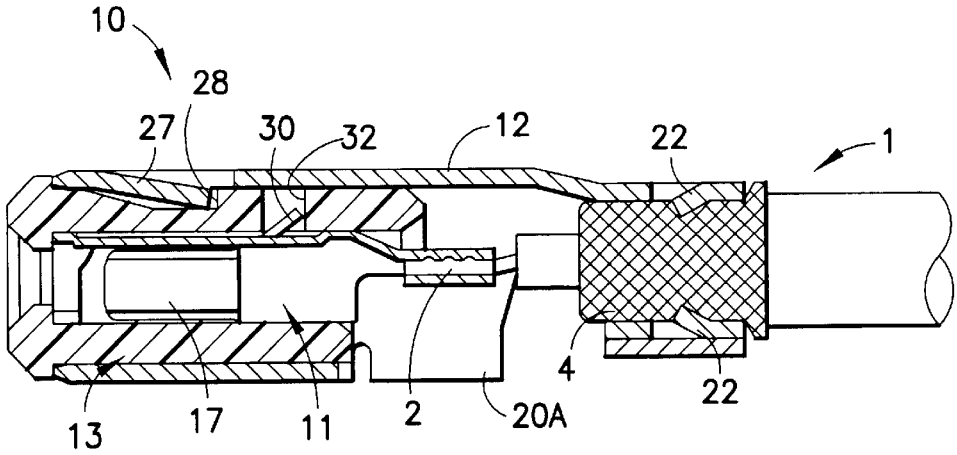
FIG. 6 is a vertical section showing an assembled state of a shielding terminal and a shielded cable.
Figure 7:
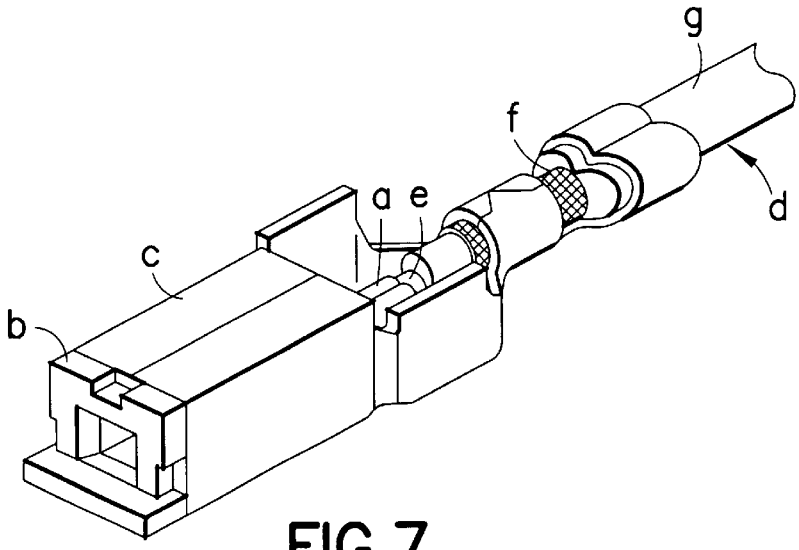
FIG.7 PRIOR ART
FIGS. 7 and 8 are a perspective view and a plan view of a prior art shielding terminal connected with a shielded cable.
Figure 8:
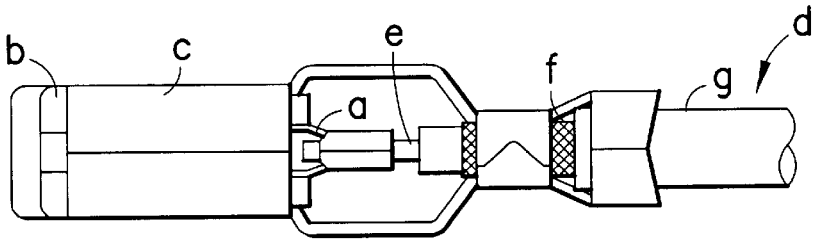
FIG.8 PRIOR ART

A female shielding terminal in accordance with the invention is identified by the numeral 10 in FIG. 6, and is crimped, folded or bent into connection with an end of a shielded cable 1. The shielded cable 1 has a known structure, with a core 2 formed by bundling a plurality of strands. An insulating layer 3 surrounds the core 2, and a shield layer 4, preferably formed from a braided wire, surrounds the insulating layer 3. A sheath 5 made of a rubber or the like concentrically surrounds the shield layer 4, as shown in FIGS. 1 and 2. In this embodiment, an end of the shielded cable 1 is processed by stripping off an end of the sheath 5, folding the thus exposed section of the braided wire 4 back on the sheath 5, and cutting off an exposed end of the insulating layer 3 to at least partly expose the core 2.

The shielding terminal 10 is comprised of an inner terminal 11, an outer terminal 12 and a dielectric element 13 as shown in FIGS. 1, 2 and 6.

The inner terminal 11 is formed by bending a metallic plate to have opposite front and rear ends. A substantially rectangular tubular female connecting portion 15 is formed at the front end, and two transversely arranged inner crimping pieces 16 are formed behind the connecting portion 15 for crimped, folded or bent connection with the core 2 of the shielded cable 1. Left and right resilient or elastic contacts 17 are formed at the respective sides of the connecting portion 15 for connection with a tab (not shown) of a mating male inner terminal. The contacts 17 cantilever forward and are bent so that facing surfaces at their leading ends bulge inwardly. The contacts 17 are resiliently or elastically deformable so that their leading ends move toward and away from each other as the tab of the mating terminal is inserted therebetween.

The outer terminal 12 also is formed e.g. by bending a metallic plate to have opposite front and rear ends. A large rectangular tubular accommodating portion 20 is formed at the front end, and two transversely arranged outer crimping pieces 21 are formed at the rear end for crimped, bent or folded connection with a folded section of the shield layer 4 of the shielded cable 1. Wedge-shaped projections 22 are formed at the base ends of the outer crimping pieces 21 and on the outer crimping piece 21 that is to be located more inside in its wound state. Further, a portion of the bottom wall at the rear end of the accommodating portion 20 is cut off, and stabilizers 23 project laterally outward from the bottom edges of the left and right side walls of the rear end of the accommodating portion 20.

The dielectric element 13 is made of an insulating material such as a synthetic resin, and electrically insulates the inner and outer terminals 11, 12 from each other. The dielectric element 13 has a shape substantially conforming to shapes of the inner and outer terminals 11, 12. More particularly, the dielectric element 13 is a substantially rectangular tube with a thick wall and is configured to fit into the front end of the accommodating portion 20 of the outer terminal 12. An accommodating hole 25 is formed inside the dielectric element 13 and is configured for receiving the connecting portion 15 of the inner terminal 11. A flange 24 is formed at the front surface of the dielectric element 13 and can be brought into abutment against the front edge of the accommodating portion 20 of the outer terminal 12. A terminal insertion opening 26 is defined at the front end of the accommodating hole 25 for receiving the tab of the mating terminal. Further, a lower half of the rear end of the dielectric element 13 is cut off to conform substantially to the configuration of the accommodating portion 20 of the outer terminal 12.

An outer metal lock 27 is formed in the upper or lateral surface of the leading end of the accommodating portion 20 of the outer terminal 12 by cutting the upper surface and bending the cut portion to extend obliquely inward and backward. A first locking hole 28 is formed in the upper surface of the leading end of the dielectric element 13, and the outer metal lock 27 of the outer terminal 12 can be fit in the first locking hole 28. The outer metal lock also may be made by embossing a corresponding portion of the accommodating portion 20 of the outer terminal 12 (not shown).

An inner metal lock 30 is formed in the upper surface of the rear end of the connecting portion 15 of the inner terminal 11 by making at least one cut in the upper surface and bending the cut portion to project obliquely outward and backward. A second locking hole 32 is formed to penetrate the upper wall of the rear end of the dielectric element 13, and the inner lock 30 of the inner terminal 11 can be fit in the second lock hole 32. The inner metal lock also may be made by embossing a corresponding portion of the inner terminal 11 (not shown).

Figure 3:
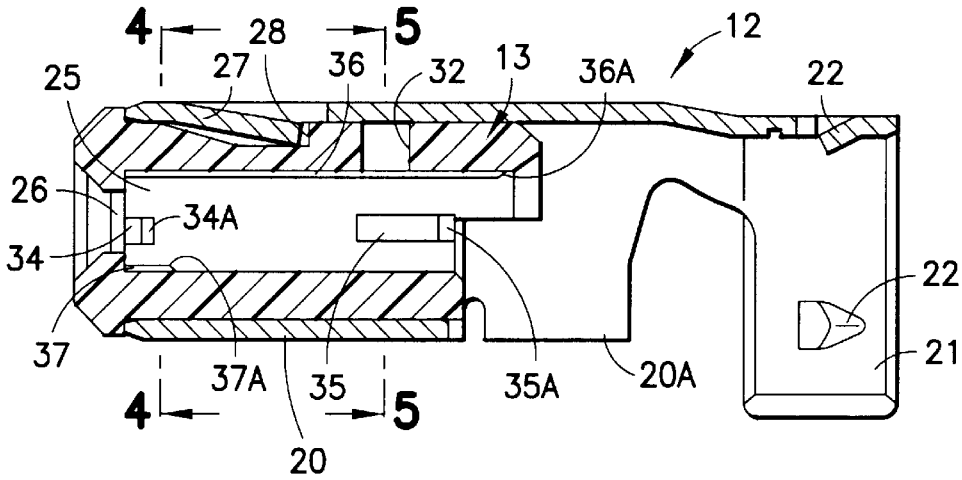
FIG. 3 is a vertical section showing a state where a dielectric element is mounted in an outer terminal.
Figure 4:
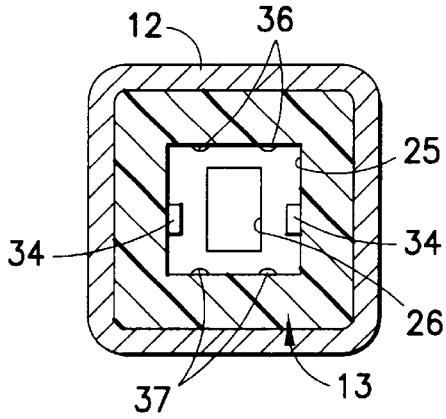
FIG. 4 is a section along 4—4 of FIG. 3.
Figure 5:
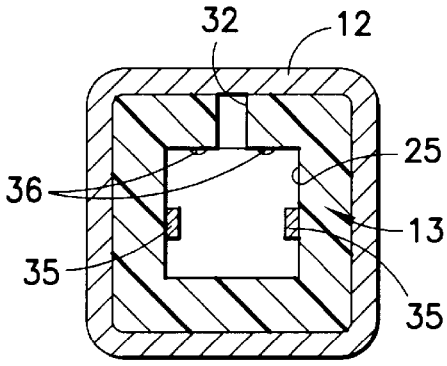
FIG. 5 is a section along 5—5 of FIG. 3.

As shown in detail in FIGS. 3 to 5, the inner surfaces of the accommodating hole 25 of the dielectric element 13 are formed with ribs 34 to 37 for partly filling or bridging a clearance between the inner surfaces and the connecting portion 15 of the inner terminal 11. A short first rib 34 and a relatively long second rib 35 are formed substantially in the middle with respect to the height direction at the front and rear ends of each of the left and right side surfaces. The ribs 34, 35 can be brought into contact with front and rear areas of the left and right side surfaces of the connecting portion 15 where the elastic contact pieces 17 are formed when the inner terminal 11 is inserted to a proper position in the dielectric element 13. The rear ends of the ribs 34, 35 are formed into slanted guide surfaces 34A, 35A, respectively.

Two third ribs 36 extend on the ceiling surface of the accommodating hole 25 at the opposite sides of the second locking hole 32 substantially along the entire length of the ceiling surface. Left and right fourth ribs 37 are formed at the front end of the bottom surface of the accommodating hole 25. When the inner terminal 11 is inserted to the proper position in the dielectric element 13, the third ribs 36 contact the left and right sides of the upper surface of the connecting portion 15 of the inner terminal 11 substantially along the entire length and the fourth ribs 37 contact the left and right sides of the front end of the bottom surface of the connecting portion 15. The rear ends of the third and fourth ribs 36, 37 are also formed into slanted guide surfaces 36A, 37A.

The shielding terminal 10 is connected with the end of the shielded cable 1 by first processing the end of the shielded cable 1, as described above. The inner crimping pieces 16 of the inner terminal 11 then are crimped, folded or bent into connection with the end of the core 2 of the shielded cable 1. The dielectric element 13 then is inserted into the accommodating portion 20 of the outer terminal 12 from front. Pushing forces on the dielectric element 13 resiliently or elastically deform the outer metal lock 27. However, the outer metal lock 27 is restored resiliently or elastically toward its original shape to fit into the first locking hole 28 when the flange 24 contacts the front edge of the accommodating portion 20, as shown in FIG. 3. As a result, the dielectric element 13 is fixed at the front end of the accommodating portion 20.

Subsequently, the inner terminal 11 is inserted into the accommodating portion 20 of the outer terminal 12 from behind and is pushed into the accommodating hole 25 of the dielectric element 13 that had been fixed in the accommodating portion 20. More particularly, the inner terminal is inserted by a jig inserted through an opening 20A in the bottom wall of the rear end of the accommodating portion 20. Pushing forces on the inner terminal 11 resiliently or elastically deform the inner metal lock 30. However, after sufficient insertion, the inner metal lock 30 is resiliently or elastically restored toward its original shape to fit into the second locking hole 32 of the dielectric element 13 when the front end of the inner terminal 11 contacts the front end wall of the accommodating hole 25 as shown in FIG. 6. As a result, the inner terminal 11 is locked in the dielectric element 13.

Simultaneously, the left and right side surfaces of the connecting portion 15 are pressed by the first and second ribs 34, 35 and the upper and bottom surfaces are pressed by the third and fourth ribs 36, 37. Thus, the inner terminal 11 will not shake.

Finally, the outer crimping pieces 21 of the outer terminal 12 are crimped and wound, bent or folded around the folded section of the braided wire 4. Thus, the outer terminal 12 is fastened to the folded section of the braided wire 4 and the end of the sheath 5. The outer crimping pieces 21 are fastened more strongly because the projections 25 bite in the braided wire 4.

As described above, the inner terminal 11 is locked in the dielectric element 13 by fitting the inner metal lock 30 of the inner terminal 11 into the second locking hole 32 of the dielectric element 13. This effectively prevents the inner terminal 11 from coming out of the dielectric element 13 when a pulling force acts on the core 2 of the shielded cable 1.

Locking is achieved by fitting the metal lock 30 into the locking hole 32, as described above. The tab of the mating male terminal then may be inserted between the elastic contact pieces 17. Pushing forces on the tab could cause the elastic contact pieces 17 to undergo an excessive elastic deformation if the inner terminal 11 and could cause the contact pieces 17 to shake in the dielectric element 13 in a transverse direction that extends parallel to the elastically deforming direction of the elastic contact pieces 17. However, in this embodiment, shake in the transverse direction is prevented by the left and right ribs 34, 35, thereby preventing the inner terminal 11 from shaking in the transverse direction. This prevents the elastic contact pieces 17 from undergoing an excessive elastic deformation.

Shake of the inner terminal 11 in the vertical direction also is prevented. Therefore, fine sliding movement and abrasion between the contact portion and the tab of the mating male terminal is avoided.

The present invention is not limited to the above described and illustrated embodiments. For example, a following embodiment is also embraced by the technical scope of the present invention as defined in the claims. Beside the following embodiment, various changes can be made without departing from the scope and spirit of the present invention as defined in the claims.

Although the female shielding terminal is illustrated in the foregoing embodiment, the present invention is similarly applicable to male shielding terminals.

What is claimed is:

1. A shielding terminal for connection with an end of a shielded cable, the shielded cable having a core and a shield layer surrounding and spaced from the core, the shielding terminal comprising:

an outer terminal configured for connection with the shield layer of the shielded cable;

a dielectric element disposed at least partly in the outer terminal, the dielectric element having an inner surface and at least one projection projecting from the inner surface;

an inner terminal disposed at least partly in the dielectric element and being configured for connection with the core of the shielded cable, the inner terminal being formed with at least one resilient contact piece for contacting a mating terminal;

at least one metal lock formed in an outer surface of the inner terminal;

at least one locking hole formed in an inner surface of the dielectric element and configured for engagement by the metal lock; and wherein the at least one projection projecting from the inner surface of the dielectric element at least partly fills a clearance between the inner surface of the dielectric element and the inner terminal in a direction substantially parallel to a resilient deforming direction of the resilient contact piece and for contacting the outer surface on the inner terminal.

2. A shielding terminal according to claim 1, wherein the at least one metal lock is formed in the inner terminal by making at least one cut in the outer surface of the inner terminal and bending portions of the inner terminal defined by the cut.

3. A shielding terminal according to claim 2, wherein the metal lock is bent to project obliquely backwards when seen in a direction of insertion of the inner terminal into the dielectric element.

4. A shielding terminal according to claim 1, wherein the outer terminal has an outer metal lock engageable with an auxiliary locking hole provided on an outer surface of the dielectric element for locking the dielectric element in the outer terminal.

5. A shielding terminal for connection with an end of a shielded cable, the shielded cable having a core and a shield layer surrounding and spaced from the core, the shielding terminal comprising:

an outer terminal configured for connection with the shield layer of the shielded cable;

a dielectric element disposed at least partly in the outer terminal, an accommodating hole extending through the dielectric element, at least one locking hole extending into the accommodating hole of the dielectric element, a plurality of filling ribs extending into the accommodating hole; and an inner terminal having a rear end configured for connection with the core of the shielded cable and an opposite front end configured for connection with a mating terminal, at least the front end being supported on the filling ribs in the accommodating hole of the dielectric element, at least one lock formed in an outer surface of the inner terminal for locked engagement with the locking hole of the dielectric element, whereby the filling ribs and the locked engagement of the lock with the locking hole prevent shaking of the inner terminal in the dielectric element.

6. The shielding terminal of claim 5, wherein two of said filling ribs are formed at locations in the accommodating hole to lie on opposite respective sides of the locking hole.

7. The shielding terminal of claim 5, wherein the inner terminal includes opposed contact pieces for contacting a mating terminal, at least two of the filling ribs being disposed forward of the contact pieces, and at least two of the filling ribs being rearward of the contact pieces.

8. A shielding terminal according to claim 5, wherein the outer terminal has an outer metal lock engageable with an auxiliary locking hole provided on an outer surface of the dielectric element for locking the dielectric element in the outer terminal.

* * * * *